US009989286B2

(12) United States Patent
Goel et al.

(10) Patent No.: US 9,989,286 B2
(45) Date of Patent: Jun. 5, 2018

(54) COMPRESSOR OPERATION MANAGEMENT IN AIR CONDITIONERS

(71) Applicant: Lennox Industries Inc., Richardson, TX (US)

(72) Inventors: Rakesh Goel, Irving, TX (US); Eric Perez, Hickory Creek, TX (US)

(73) Assignee: Lennox Industries Inc., Richardson, TX (US)

( * ) Notice: Subject to any disclaimer, the term of this patent is extended or adjusted under 35 U.S.C. 154(b) by 865 days.

(21) Appl. No.: 14/109,745

(22) Filed: Dec. 17, 2013

(65) Prior Publication Data

US 2015/0168042 A1 Jun. 18, 2015

(51) Int. Cl.
*F25B 49/02* (2006.01)
*F25B 1/10* (2006.01)

(52) U.S. Cl.
CPC ..... *F25B 49/022* (2013.01); *F25B 1/10* (2013.01); *F25B 2400/075* (2013.01); *F25B 2600/0251* (2013.01); *F25B 2600/23* (2013.01)

(58) Field of Classification Search
CPC .. F15B 49/022; F15B 1/10; F15B 2600/0251; F15B 2600/23; F15B 2400/075
See application file for complete search history.

(56) References Cited

U.S. PATENT DOCUMENTS 4,614,089 A 9/1986 Dorsey
5,195,331 A 3/1993 Zimmern
5,299,432 A * 4/1994 Nakae ..... F24F 11/00 62/298
6,301,912 B1 * 10/2001 Terai ..... F04C 23/008 418/55.5
8,601,828 B2 * 12/2013 Moseley ..... F04B 49/10 62/229
2003/0205052 A1 * 11/2003 Kim ..... F25B 1/10 62/228.1
2004/0189590 A1 * 9/2004 Mehaffey ..... G05D 16/2066 345/156
2006/0037335 A1 * 2/2006 Song ..... F25B 49/022 62/196.3
2007/0266719 A1 11/2007 Kang et al.
2008/0156014 A1 7/2008 Kopko et al.
2009/0225479 A1 * 9/2009 Jayanth ..... G01R 19/10 361/30
2009/0288432 A1 * 11/2009 Lifson ..... F25B 5/02 62/115

(Continued)

FOREIGN PATENT DOCUMENTS

DE 69728078 T2 2/2005
EP 1717075 A1 2/2006
EP 2620721 A2 7/2013

*Primary Examiner* — Kun Kai Ma
(74) *Attorney, Agent, or Firm* — Baker Botts L.L.P.

(57) ABSTRACT

In various implementations, an air conditioning system may include one or more compressors. The operation of the compressor(s) may be managed. For example, when an air conditioner is allowed to operate after being shut down, a first compressor may be allowed to operate and a wait time may elapse prior to starting at least one other compressor. When a compressor has multiple stages of operation, in some implementations, a first compressor may be allowed to operate at a low stage and a wait time may elapse prior to starting a higher stage of operation of the first compressor.

19 Claims, 4 Drawing Sheets

(56) References Cited

U.S. PATENT DOCUMENTS

| | | | | |
|---|---|---|---|---|
| 2011/0314845 | A1* | 12/2011 | Lifson | F25B 49/022 62/115 |
| 2012/0167602 | A1* | 7/2012 | Taras | F25B 49/02 62/115 |
| 2014/0020410 | A1 | 1/2014 | Perez et al. | |
| 2014/0137573 | A1* | 5/2014 | Lin | F25B 49/02 62/56 |
| 2015/0027144 | A1* | 1/2015 | Lee | F25B 47/025 62/80 |
| 2015/0128597 | A1* | 5/2015 | Schlak | F03B 13/00 60/719 |
| 2016/0102901 | A1* | 4/2016 | Christensen | F25B 9/008 62/117 |

* cited by examiner

COMPRESSOR OPERATION MANAGEMENT IN AIR CONDITIONERS

TECHNICAL FIELD

The present disclosure relates to managing compressor operation in air conditioners.

BACKGROUND

When air conditioners are turned off (e.g., due to lack of requests for operation and/or due to shut down, such as when a high pressure trip is activated), refrigerant may collect in a portion of the air conditioner. Thus, when the operations of the air conditioner are resumed, the pressure in the air conditioner or portions thereof may spike.

SUMMARY

In various implementations, operation of an air conditioner with more than one compressor may be managed. When a request for operation of an air conditioner is received, a wait time may be retrieved. For example, when an air conditioner is off (e.g., due to satisfaction of a previous request and/or a high pressure event), the initiation of operation of the compressors may be staggered based on a wait time. The wait time may be at least partially based on properties of the air conditioner, properties of an expansion device of the air conditioner, ratio of condenser volume to evaporator volume, ambient temperatures, etc.

In various implementations, an air conditioner may include a first compressor, at least one second compressor, and an expansion device. The air conditioner may include a memory storing one or more wait times, and a controller (e.g., including a processor to execute instructions). The controller may receive a request for operation of an air conditioner and retrieve a wait time. The controller may allow operation of the first compressor of the air conditioner, and restrict operation of the second compressor of the air conditioner for a period of time approximately equal to the retrieved wait time. The controller may allow operation of the second compressor after the period of time.

Implementations may include one or more of the following features. The air conditioner may include a microchannel condenser. The air conditioner may include a tandem compressor, which includes the first compressor and the second compressor of the air conditioner. The expansion device of the air conditioner may include a thermal expansion device. In some implementations, a thermal expansion device may include a bulb and a heat transfer element. A temperature of the bulb may at least partially control an amount of refrigerant allowed to pass through the thermal expansion device. The controller may allow heat transfer between the heat transfer element and the bulb to alter a temperature of the bulb for at least a portion of the wait time, and adjust an amount of refrigerant allowed to flow through the thermal expansion valve based at least partially on the altered temperature of the bulb. The wait time may be based on at least one property of a component of the air conditioner. In some implementations, the first compressor may include a high stage and at least one low stage, and allowing operation of the first compressor comprises allowing operation of the first compressor at one of the low stages. The controller may restrict operation of at least a portion of the air conditioner, in some implementations; and, a request for operation of the air conditioner may be received when operation of at least a portion of the air conditioner is restricted.

In various implementations, a request for operation of an air conditioner may be received. The air conditioner may include more than one compressor, and operation of at least one of the compressors may be restricted. A wait time may be retrieved. Operation of a first compressor of the air conditioner may be allowed and operation of a second compressor of the air conditioner may be restricted for a period of time approximately equal to the retrieved wait time. An operation of the second compressor may be allowed after the period of time.

Implementations may include one or more of the following features. The wait time may be determined based at least partially on at least one of a property of the air conditioner; an ambient temperature proximate at least a portion of the air conditioner and/or a ratio of a volume of a condenser of the air conditioner to a volume of an evaporator of the air conditioner, in some implementations. In some implementations, a wait time may be based on a response time of the expansion device. The first compressor may include a low stage of operation and at least one higher stage of operation, and allowing operation of the first compressor may include allowing operation at the low stage. In some implementations, when a first compressor includes more than one stage of operation, a second wait time may be retrieved, and operation of the first compressor at one of the higher stages may be allowed after a period of time approximately equal to the second wait time. The air conditioner may include a tandem compressor assembly that includes at least two of the compressors of the air conditioner. The expansion device may automatically control an amount of refrigerant allowed to pass through the expansion device. The automatic control of the expansion device may be adjusted such that the amount of refrigerant allowed to pass during at least a portion of the wait time is greater than the amount of refrigerant allowed to pass during automatic control. In some implementations, operation of at least one of the compressors may be restricted based on satisfaction of a previous request for operation of the air conditioner, and the request for operation of the air conditioner may be received while the operation of at least one of the compressors is restricted based on satisfaction of a previous request. Operation of at least one of the compressors may be restricted based on a high pressure event, in some implementations.

In various implementations, a request for operation of an air conditioner with more than one compressor may be received when operation of at least a portion of the air conditioner is restricted. An ambient temperature proximate the air conditioner may be determined. A wait time may be retrieved and the wait time may be adjusted if the determined ambient temperature is greater than a predetermined high ambient temperature value. Operation of a first compressor of the air conditioner may be allowed; and, operation of a second compressor of the air conditioner may be restricted for a period of time that is approximately equal to the adjusted wait time, if the determined ambient temperature is greater than a predetermined high ambient temperature value. allowing operation of the second compressor after the period of time.

Implementations may include one or more of the following features. Operation of the second compressor may be restricted for a period of time that is approximately equal to the retrieved wait time, if the determined ambient temperature is not greater than a predetermined high ambient temperature value. In some implementations, a heating element may be allowed to provide heat to a bulb of a thermal expansion device of the air conditioner during the adjusted wait time. Operation of at least a portion of the air conditioner may be restricted based on satisfaction of a previous request for operation of the air conditioner, and the request for operation of an air conditioner may be received when operation of at least a portion of the air conditioner is restricted based on satisfaction of a previous request. In some implementations, operation of at least a portion of the air conditioner may be restricted based on a high pressure event. A determination may be made whether the high pressure event has terminated, and operation of the air conditioner may be automatically requested when the determination is made that the high pressure event has terminated.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, operation of an air conditioner with more than one compressor may be managed. For example, when operation of at least a portion of an air conditioner is restricted (e.g., when the air conditioner is off), initiation of the operation of the air conditioner (e.g., start-up) may be managed. When an air conditioner operation is restricted, refrigerant may accumulate in portions of the air conditioner (e.g., since the expansion device may be closed and/or operation of one or more compressors may be restricted). Thus, initiation of operation of the air conditioner by allowing both compressors to respond to a request for operation may cause a high pressure event (e.g., pressure in at least a portion of the air conditioner that is greater than a predetermined high pressure). Thus, the operation of the compressors may be managed such that a first compressor may be allowed to operate and one or more second compressors may be allowed to operate after wait time(s). The wait time may be the amount of time that elapses between allowing the operation of the first compressor and allowing the operation of one or more second compressors. Introducing the wait time may inhibit the high pressure event when restarting operation(s) of the air conditioner.

Figure 1:
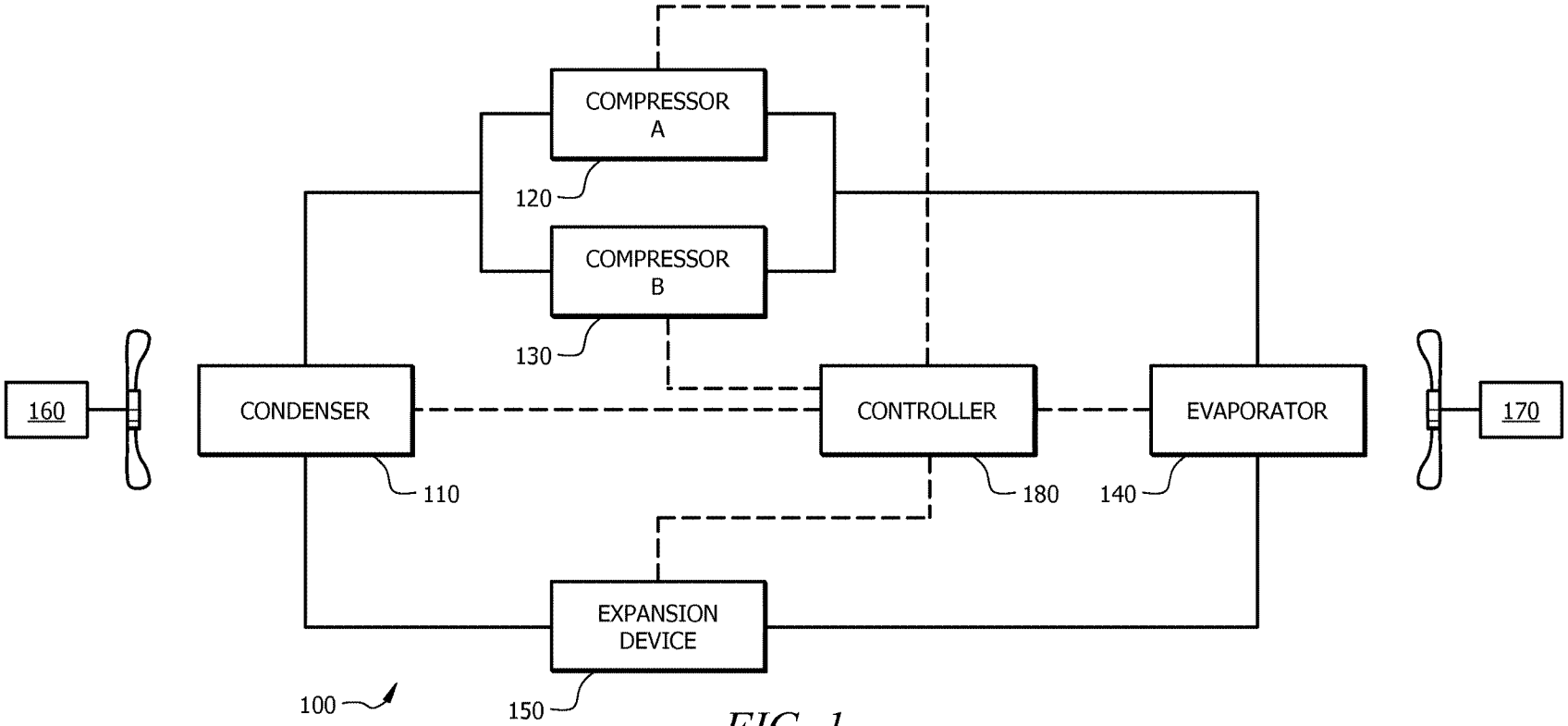
FIG. 1 illustrates an implementation of an example air conditioner.

FIG. 1 illustrates an implementation of an example air conditioner 100. The air conditioner may include components such as a condenser 110, compressor A 120, compressor B 130, and evaporator 140. Lines (e.g., tubing) may couple various components and allow refrigerant to flow in and/or out of various components of the air conditioner 100. Fans 160, 170 may cause air to flow through the condenser 110 and/or the evaporator 170.

The condenser may include an appropriate condenser. In some implementations, the condenser may be a microchannel condenser (e.g., condenser with a channel size less than approximately 1 mm). Microchannel condensers may be sensitive to operating conditions during operation of the air conditioner (e.g., when compared with other condensers (e.g., condenser with tube size greater than 5 mm)). For example, microchannel condensers may be sensitive to refrigerant charge (e.g., a level of refrigerant in the system). When a microchannel condenser has a refrigerant charge greater than a maximum operating charge, the pressure in the microchannel condenser may become elevated due to the refrigerant capacity size difference between the microchannel condenser and the evaporator. The high pressures (e.g., pressures greater than approximately 615 psi, with a refrigerant that includes R-410A refrigerant) may cause mechanical failure, including prefailure events, such as excessive wear on parts and/or high pressure switch activations. Thus, when refrigerant pools in portions of the air conditioner, the pressure in the microchannel condenser may become elevated (e.g., since the capacity of the microchannel condenser may be substantially smaller than the total capacity of the air conditioner accumulation of refrigerant proximate the microchannel may cause high pressures) and mechanical failure of the air conditioning system may occur.

The compressors 120, 130 of the air conditioner may include any appropriate arrangement of compressors (e.g., in series and/or in parallel). The compressors 120, 130 may include a tandem compressor assembly. The tandem compressor assembly may allow more than one compressor (e.g., compressor A 120 and compressor B 130) to share discharge lines and suction lines.

Compressor A 120 and/or compressor B 130 may include single stage and/or multi-stage (e.g., more than one stage) compressors. Compressor A 120 and Compressor B may be independently operable, in some implementations. For example, compressor A 120 may be allowed to operate and compressor B may be restricted from operation.

The air conditioner may include an expansion device 150, as illustrated. The expansion device may include any device that at least partially expands refrigerant passing through the device. For example, the expansion device 150 may include a thermal expansion valve, an orifice, and/or an electronic expansion valve.

In some implementations, the expansion device may include a thermal expansion valve with a bulb. For example, the thermal expansion device described in U.S. patent application Ser. No. 13/600,685 entitled "Controlling Metering Devices" filed on Aug. 31, 2012, may be utilized as the expansion device. As described, a control system may alter the automatic control of the thermal expansion valve by altering a temperature of the bulb. For example, the control system may include one or more heat transfer elements coupled to the bulb and a controller coupled to the heat transfer element(s). The heat transfer element(s) may be capable of altering a temperature of the bulb. For example, the heat transfer elements may generate heat and/or cold, deliver heat to, and/or remove heat from the bulb of the thermal expansion valve. For example, the bulb may be 50° F. and the heat transfer element may deliver heat to the bulb to raise the temperature of the bulb to 60° F. Thus, the automatic operation and adjustments of the thermal expansion valve may then be altered to operate based on the new altered temperature generated by the heat transfer elements.

A controller 180 (e.g., a computer) may be coupled (e.g., communicably, such as by wires or linked by Wi-Fi) to component(s) of the air conditioner 100 and control various operations of the component(s) and/or system. For example, the controller 180 may include an operation module and/or compressor management module, stored in a memory of the controller and executable by a processor of the controller, to perform various operations of the air conditioner 100. The operation module may control operations of the air conditioner 100, such as receiving requests for operation, determining whether to respond to requests for operation, operating various components (e.g., compressors, reversing valves, and/or expansion valves), other described operations, etc. The compressor management module may control operation and/or restriction of operation of the compressors of the air conditioner 100. For example, the compressor management module may determine whether to allow a wait time, determine and/or retrieve wait times, allow one or more compressors to operate and/or restrict operation of one or more compressors. In some implementations, the compressor management module may adjust the amount of refrigerant allowed to flow through the expansion device 150.

Although FIG. 1 illustrates an implementation of an air conditioner, other implementations may be utilized as appropriate. For example, the air conditioner may include any components, as appropriate. The air conditioner may not include an expansion device. The air conditioner may include more than two compressors (e.g., a tandem compressor with four compressors). In some implementations, the expansion device may include more than one expansion device. The air conditioner may include a heat pump. An air conditioner that includes a heat pump may include a reversing valve to allow cooling and heating operations.

In some implementations, the air conditioner may include one compressor with more than one stage (e.g., a low stage and one or more high stages and/or a high stage and one or more low stages). In an air conditioner with one multi-stage compressor (e.g., a compressor that includes more than one stage of operation), a wait time may be utilized between stages. For example, compressor may be allowed to operate at a low stage, and one or more higher stages of the compressor may be restricted. At least one higher stage of the compressor may be allowed after a period of time approximately equal to the wait time has elapsed.

In some implementations, a portion of the air conditioner 100 may be disposed outside a building (e.g., an "outdoor portion" on the ground proximate a building and/or on a roof of the building) and a portion of the air conditioner may be disposed inside the building (e.g., an "indoor portion"). For example, the outdoor portion may include condenser 110 and fan 160 and the indoor portion may include the evaporator 140 and fan 170. In some implementations, such as a rooftop unit, the condenser 110, fan 160, compressor A 120, compressor B 130, evaporator 140, fan 170, and the expansion device 150 may be disposed in the outdoor portion. The outdoor and/or indoor portion may be at least partially disposed in housing(s).

During a cooling cycle of the air conditioner 100, cool air may be provided by blowing air (e.g., from fan 170) at least partially through the evaporator 140. The evaporator 140 may evaporates liquid refrigerant in the evaporator. The evaporator may reduce a temperature of the air and the cool air may be provided to a location (e.g., via ducting). The gaseous refrigerant may exit the evaporator 140, and may be compressed by compressor A 120 and compressor B 130, and delivered to a condenser 110. The condenser 110 may condense the gaseous refrigerant by blowing air (e.g., from a fan 160) at least partially through the condenser 130 to remove heat from the gaseous refrigerant.

The air conditioner operation may be restricted. For example, when an air conditioner has satisfied a previous request for operation (e.g., from a user), the air conditioner may be turned off. When the air conditioner is turned off, operation of compressor(s) may be restricted and an expansion device may be closed. In some implementations, a high pressure event may occur (e.g., pressure greater than a predetermined high pressure may be detected in at least a portion of the air conditioner and/or high pressure switch may be activated) and operation of one or more portions of the air conditioner may be restricted to inhibit mechanical failure. In some implementations, an expansion device may be open to allow the flow of refrigerant through the expansion device when a high-pressure event occurs.

In some implementations, when the air conditioner operation is requested after at least a portion of the operation of the air conditioner has been restricted (e.g., restarting the air conditioner and/or turning the air conditioner back on), if the compressor operation of more than one compressor is initiated, then a high pressure event may occur (e.g., due to accumulation of refrigerant in portions of the air conditioner). Thus, the operation of the compressors may be managed.

Figure 2:
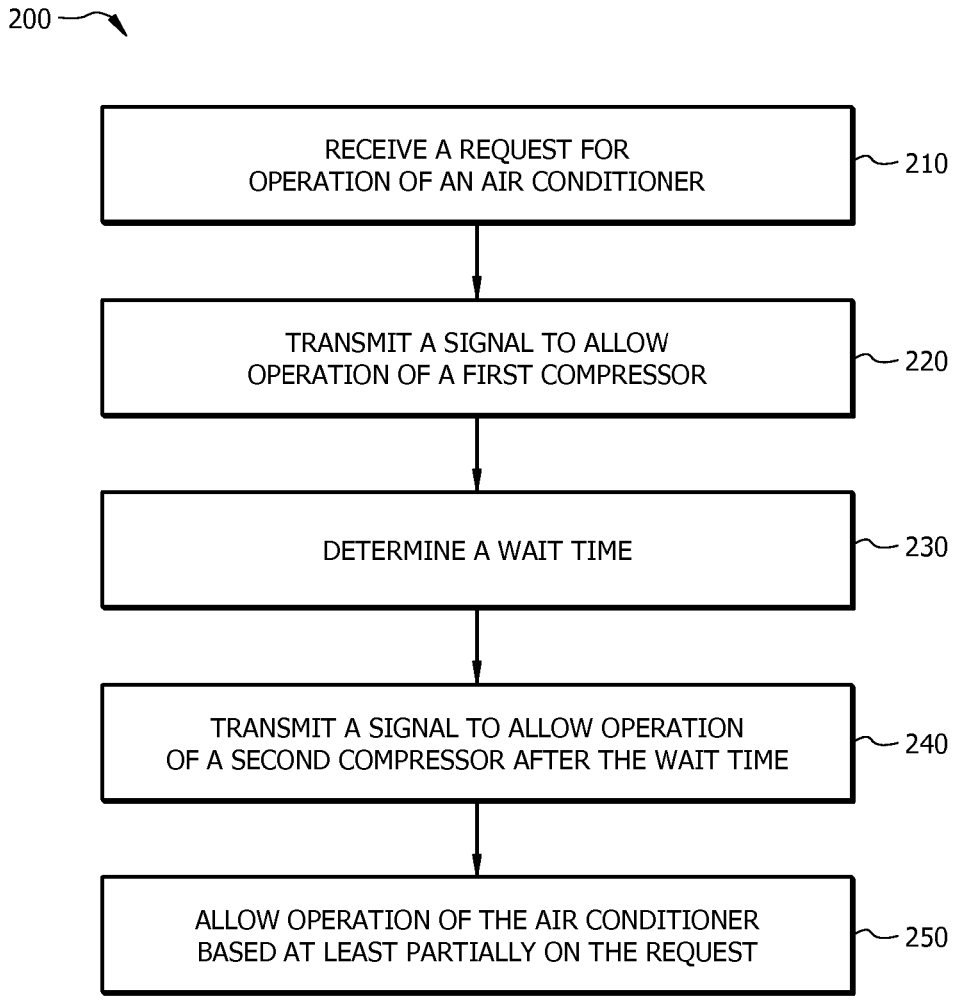
FIG. 2 illustrates an implementation of an example process for managing operation of compressors in an air conditioner.

FIG. 2 illustrates an implementation of an example process 200 for managing compressor operation. A request for operation of an air conditioner may be received (operation 210). For example, a user may request that an air conditioner be turned on to provide cool air to a location. The request may include set points, such as temperature and/or humidity, to satisfy.

A signal may be transmitted to allow operation of a first compressor (operation 220). For example, a controller may transmit a signal to a compressor to allow operation. The first compressor may be operated at least partially based on the request.

A wait time may be determined (operation 230). The wait time may be an amount of time to elapse prior to allowing operation of one or more additional compressors in an air conditioner. For example, a wait time may be the amount of time that elapses between allowing a first compressor to operate and allowing one or more second compressors to operate. The wait time may be at least 10 seconds and/or less than 5 minutes, in some implementations. The wait time may be based on a component of the air conditioner (e.g., expansion device and/or microchannel condenser). In some implementations, the wait time may be based on a property of the expansion device, such as the response time (e.g., the amount of time for a device, such as a valve to move from a closed position to a open position). In some implementations, a wait time may be retrieved from a memory coupled to the air conditioner.

A signal may be transmitted to allow operation of a second compressor after the wait time (operation 240). The operation of the second compressor in response to the request for operation may be restricted after the first compressor is allowed to operate. After a period of time approximately equal to the wait time has elapsed, the second compressor may be allowed to operate (e.g., based at least partially on the request for operation).

Restricting operation of the second compressor during the wait time may allow circulation of at least a portion of the refrigerant in at least a portion of the air conditioner by the first compressor. For example, the wait time may be based at least partially on the response time of the expansion device. When at least a portion of the air conditioner operation is restricted, the expansion device may restrict the flow of refrigerant through the air conditioner (e.g., a thermal expansion valve may be closed). The refrigerant may then accumulate proximate the expansion device and/or the condenser. When the air conditioner is allowed to operate (e.g., in response to a request), the accumulated refrigerant may cause the pressure in the condenser to elevate quickly since the expansion device may have a delay in opening (e.g., based on a response time of the expansion device). In a microchannel condenser and/or other types of pressure sensitive condensers, a high pressure event may then occur due to the accumulated refrigerant effects. The high pressure event may restrict operation of the air conditioner and thus inhibit responding to requests for operation. By allowing the first compressor to operate while restrict the second compressor, instability, such as pressure spikes, may be inhibited.

Operation of the air conditioner may be allowed based at least partially on the request (operation 250). For example, since operation of the air conditioner in response to requests for operation may include operation of the first and second compressors (e.g., in tandem operation), once the operation of the first and second compressors are allowed, the air conditioner may operate to satisfy the set points included in a request.

Process 200 may be implemented by various systems, such as system 100. In addition, various operations may be added, deleted, and/or modified. For example, the wait time may be at least 10 seconds. The wait time may be greater than an amount of time between a transmission of a signal. For example, when restarting an air conditioner, a plurality of signals may be sent to the components to allow operations. A delay based on a controller's inability to transmit multiple signals simultaneously may exist such that a period of time (e.g., 1 second) exists between transmission of signals to be performed concurrently. The wait time may be greater than this period of time, in some implementations.

In some implementations, the first compressor may include a multi-stage compressor, which includes a high stage and at least one low stage. Allowing the operation of the compressor may include allowing the operation of the first compressor in at least one of the low stages of the compressor. Operation of the first compressor at the high stage may be restricted, in some implementations. The condenser may include a microchannel condenser.

In some implementations, a first compressor may include a low stage and at least one higher stage of operation. When the first compressor is allowed to operate, the first compressor may be allowed to operate at the low stage, and operation of the higher stages of the compressor and second compressor may be restricted. A wait time may be retrieved. A determination may be made (e.g., by the controller) whether to allow operation of a higher stage of the first compressor and/or operation of the second compressor. The determination of whether to allow a higher stage of the first compressor and/or the second compressor may be made based on the request for operation, in some implementations. After a period of time has elapsed that is approximately equal to the wait time, the controller may allow a higher stage of operation of the first compressor and/or operation of the second compressor based on the determination. In some implementations, more than one wait time may be retrieved. A second compressor may be allowed to operate after a period of time has elapsed that is approximately equal to a first wait time and/or one or more higher stages of the first compressor may be allowed after one or more second wait times. In some implementations, the second compressor may include more than one stage of operation. When the second compressor is allowed to operate (e.g., after a wait time has elapsed), the second compressor may operate at a low stage. Third wait time(s) associated with higher stages of the second compressor may be retrieved and one or more higher stages of the second compressor may be allowed after a period of time has elapsed that is approximately equal to the third wait time(s).

In some implementations, the air conditioner may include one first compressor. The first compressor may include a low stage and at least one higher stage of operation. When the first compressor is allowed to operate, the first compressor may be allowed to operate at the low stage. A wait time may be retrieved and operation of the higher stages of the compressor may be restricted during a period of time approximately equal to the wait time. One or more higher stages of the first compressor may be allowed after the wait time has elapsed.

In some implementations, the expansion device may include a thermal expansion device. For example, a thermal expansion device may include a thermal expansion valve that includes a bulb, as described in U.S. patent application Ser. No. 13/600,685. As described, since the valve position is based on the temperature of the bulb, heat transfer elements may be coupled to the bulb and allow adjust the temperature of the bulb and thus adjust the valve position (e.g., open, partially open and/or closed). In some implementations, this thermal expansion valve may be utilized to adjust the valve position before the first compressor is allowed to operation and/or during the wait time after the first compressor is allowed to operate. For example, a controller may allow the first compressor to operate and may transmit a signal to the heat transfer elements cause the temperature of the bulb of the thermal expansion valve to increase. The increase in temperature may cause the thermal expansion valve to open more and/or open more quickly (e.g., when compared with allowing the bulb to automatically adjust the valve position based on the system conditions).

In some implementations, the controller may receive a request for operation and determine that operation of the air conditioner or portions thereof have been restricted (e.g., the air conditioner is off). The controller may then transmit a signal to the heating elements cause the temperature of the bulb of the thermal expansion valve to increase. The controller may then retrieve one or more wait times. The controller may allow a first wait time to elapse prior to allowing operation of the first compressor. In some implementations, the first wait time may be zero. The controller may then allow a second wait time to elapse prior to allowing operation of the second compressor. The first and/or second wait times may be based at least partially on the response time of the thermal expansion valve. Thus, the thermal expansion device may be allowed to at least partially open prior to allowing the first compressor and/or the second compressor to operate. This may increase the stability of the system on start-up and/or inhibit high pressure events at start up (e.g., responding to a request for operation when operation of one or more portions is restricted).

In some implementations, the request for operation of the air conditioner may be automatically generated by the air conditioner (e.g., an operation module of the controller). The air conditioner may be off (e.g., operation of at least a portion of the air conditioner may be restricted). For example, a temperature proximate at least a portion of the air conditioner, such as a thermostat) may be determined. When the determined temperature is not within a predetermined set point temperature range (e.g., a tolerance of plus or minus 3 degrees) of a previously provided set point and/or default set points, then a request for operation of an air conditioner may be automatically generated.

A wait time may be determined, in various implementations. The wait times may be determined by the air conditioner during use and/or based on stored values for wait times. For example, wait times and/or default wait times may be factory installed in an air conditioner. In some implementations, a wait time may be based at least partially on a property of the expansion device (e.g., response time), a property of the air conditioner (e.g., types of components, number of components, properties of components, total volume, etc.), ambient temperature proximate at least a portion of the air conditioner (e.g., condenser), and/or ratio of condenser volume to evaporator volume).

In some implementations, the memory of the air conditioner may store a single wait time or a plurality of wait times. For example, a wait time table may be stored in a memory and an appropriate wait time may be selected by the compressor management module based on, for example, the air conditioner properties, ambient temperature, etc.

Figure 3:
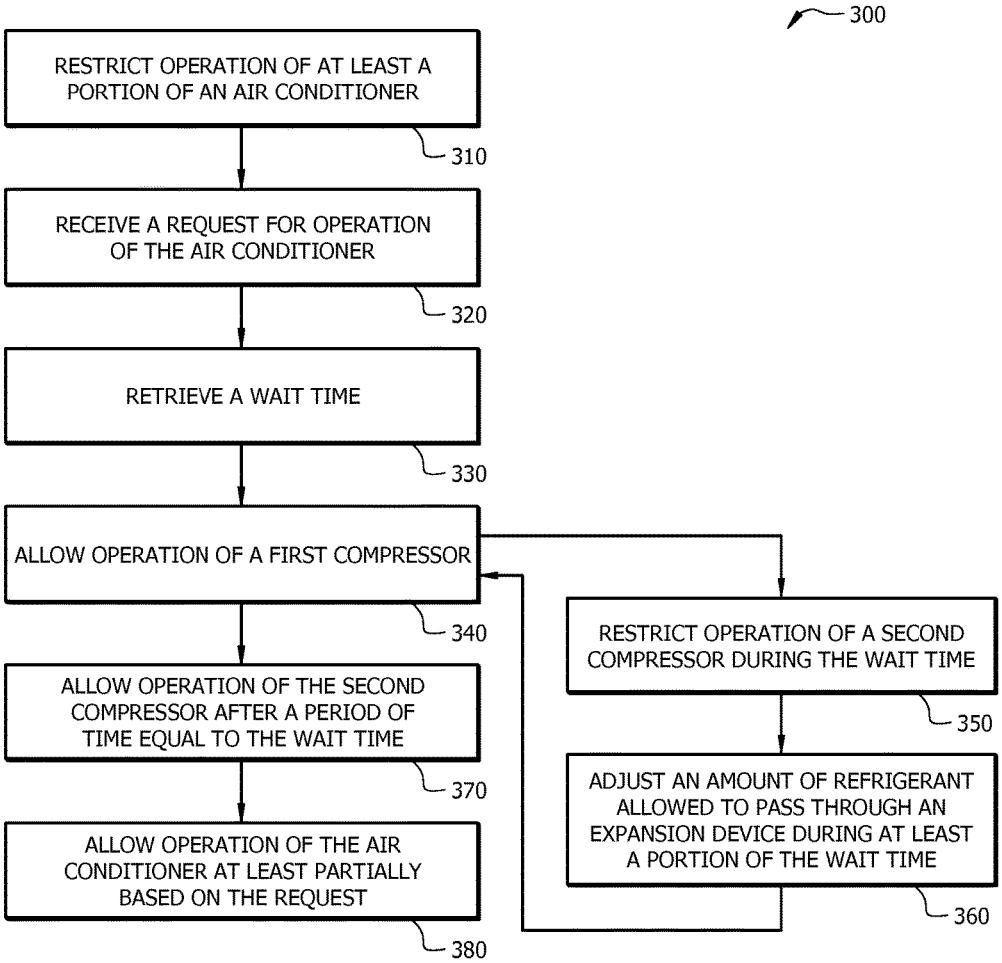
FIG. 3 illustrates an implementation of an example process for managing operation of an air conditioner.

FIG. 3 illustrates an implementation of an example process 300 for managing operation of an air conditioner. Operation of at least a portion of the air conditioner may be restricted (operation 310). For example, the controller may restrict operation of the air conditioner or portions thereof during high pressure events, when a request for operation has not been received, and/or when a previous request for operation has been satisfied. In some implementations, refrigerant flow through the expansion device may be restricted (e.g., a valve may be closed) when operation of at least a portion of the air conditioner, such as the compressor and/or fans, are restricted.

A request for operation of the air conditioner may be received (operation 320). For example, a user may request operation of the air conditioner to provide cool air to a location. The controller (e.g., an operation module of the controller) may receive the request. The compressor management module may control the operation of the compressors to inhibit a high pressure event due to start-up of the air conditioner (e.g., responding to requests for operation after a period of restricted activity).

A wait time may be retrieved (operation 330). For example, a memory of the air conditioner may store wait time(s). The compressor management module of the controller may retrieve a wait time. The wait time may be based on a response time of the expansion device. For example, if 20 seconds elapse when an expansion device moves from an approximately closed position to an approximately open position, then a wait time may be based on the 20 second response time. In some implementations, the wait time may be approximately equal to the response time.

Allow operation of the first compressor (operation 340). The controller may transmit a signal to the first compressor to allow operation. In some implementations, the first compressor may be allowed to operate based at least partially on the received request for operation.

Operation of the second compressor may be restricted during the wait time (operation 350). For example, the controller may restrict the second compressor from operating in response to the received request.

An amount of refrigerant allowed to pass through an expansion device may be adjusted during at least a portion of the wait time (operation 360). For example, the controller (e.g., a module of the controller) may transmit a signal to the expansion device prior to allowing the first compressor and/or the second compressor to operate. The signal may increase the amount of refrigerant allowed to pass through the expansion device (e.g., during the wait time). After the wait time, the controller may allow the expansion device to automatically control the amount of refrigerant allowed to pass through the system, in some implementations.

Operation of the second compressor may be allowed after a period of time approximately equal to the wait time has elapsed (operation 370). The second compressor may be allowed to operate in response to the request for operation after the wait time has elapsed. For example, after a wait time of 10 seconds, the second compressor may be allowed to operate.

Operation of the air conditioner at least partially based on the request may be allowed (operation 380). For example, since restriction(s) of the compressor operation may have been removed after the wait time, the air conditioner may control the operation of the compressors to satisfy the request for operation.

Process 300 may be implemented by various systems, such as system 100. In addition, various operations may be added, deleted, and/or modified. In some implementations, process 300 may be performed in combination with other processes such as process 200. For example, a wait time may be at least 10 seconds. In some implementations, more than one wait time may be retrieved. For example, wait times may be retrieved that are associated with one or more stages of operation of a compressor and/or associated with a predetermined compressor. The compressor and/or stages of operation of the compressor may be allowed after the retrieved associated wait time has elapsed.

In some implementations, at least two of the compressors may include a tandem compressor assembly. For example two or more of the compressors may be disposed in a tandem arrangement and may each utilize the same suction line and discharge line. In some implementations, the first compressor may be allowed to operate at a first stage and be restricted from operation at a second stage, which is higher than the first stage, during the wait time. In some implementations, more than two compressors may be utilized and one or more wait times may be utilized to stagger the initiation of operation of the compressors.

In some implementations, the expansion device may be an electronic expansion device or other type of expansion device. For example, during at least a portion of the wait time a signal may be transmitted to the expansion device such that more refrigerant is allowed to pass through the expansion device (e.g., when compared with the amount that would be allowed to pass though if the signal was not transmitted and/or when compared to the amount that would be allowed to pass during automatic control of an expansion device). In some implementations, the signal may be transmitted prior to operation of the first compressor.

In some implementations, ambient temperature (e.g., ambient temperature proximate a portion of the air conditioner such as the condenser) may affect operation of the air conditioner. For example, ambient temperature greater than a predetermined high ambient temperature (e.g., greater than approximately 95 degrees Fahrenheit and/or greater than approximately 115 degrees Fahrenheit) may cause pressures in at least a portion of the air conditioner, such as the condenser, to be elevated. When the condenser is pressure sensitive, such as a microchannel condenser, restarting operation of the air conditioner (e.g., after the air conditioner has been off and/or after a high pressure event) may allow a high pressure event to occur due to operation of the air conditioner. Thus, the wait time may be adjusted when the ambient temperature is greater than a predetermined high ambient temperature.

For example, a request for operation of an air conditioner may be received. An ambient temperature (e.g., proximate a condenser or other outdoor portion of an air conditioner) may be determined and a wait time may be retrieved (e.g., from a memory of the air conditioner). The wait time may be a wait time associated high ambient temperatures and may be greater than the wait time when ambient temperatures are not determined to be greater than the predetermined high ambient temperature. In some implementations, a wait time may be retrieved and adjusted based on the determined ambient temperatures. For example, when an ambient temperature is in a first ambient temperature range (e.g., greater than 115 degrees Fahrenheit, greater than 95 degrees Fahrenheit, greater than approximately 95 degrees Fahrenheit and less than 115 Fahrenheit degrees and/or greater than approximately 85 Fahrenheit degrees and less than approximately 95 degrees Fahrenheit), the wait time may be adjusted. For example, a first correction factor may be added to the retrieved wait time (e.g., add approximately 20 seconds to the wait time). In some implementations, if the ambient temperature is in a second range of ambient temperatures (e.g., less than approximately 15 degrees Fahrenheit, greater than 115 degrees Fahrenheit) a second correction factor may be added to the retrieved wait time (e.g., add approximately 45 seconds to the wait time). The first compressor may then be allowed to operate. The operation of the second compressor may be restricted during the adjusted wait time. The second compressor may be allowed to operate after a period of time that is approximately equal to the adjusted wait time has elapsed. The air conditioner may then be allowed to operate based at least partially on the request for operation. In some implementations, the controller (e.g., a module of the controller) may adjust the automatic control of the expansion device prior to allowing the first compressor and/or the second compressor to operate, as described. For example, a compressor management module may transmit a signal to alter the operations of the expansion device such that an amount of refrigerant allowed to pass through the expansion device is increased during at least a portion of the adjusted wait time.

In some implementations, operation of at least a portion of the air conditioner may be restricted when the request for operation of the air conditioner is received. For example, the air conditioner may have satisfied a previous request for operation. The operation of the air condition may have been at least partially restricted (e.g., fan(s) and/or compressor operation(s) restricted) upon satisfaction of the previous request. Thus, when the request for operation is received, the air conditioner must restart. To inhibit high pressure event (e.g., measured pressure in at least a portion of the air conditioner exceeding a predetermined high pressure, such as 460 psi), a wait time and/or expansion device adjustments may be utilized as described.

Figure 4:
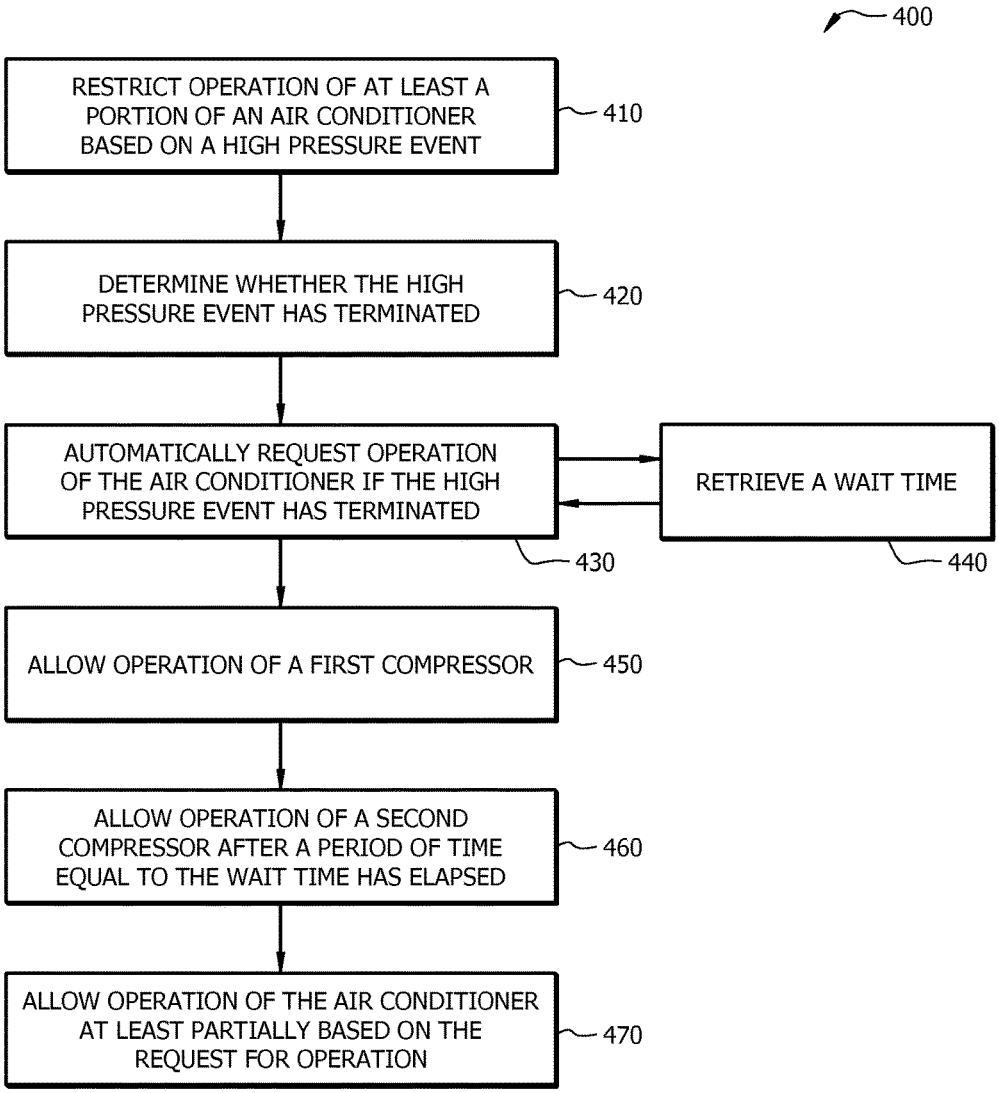
FIG. 4 illustrates an implementation of an example process for managing operation of compressors after a high pressure event.

In some implementations, operation of at least a portion of the air conditioner may be restricted due to a high pressure event when the request for operation of the air conditioner is received. FIG. 4 illustrates an implementation of an example process 400 for managing operation of compressors after a high pressure event. A high pressure event may occur when a pressure in at least a portion of the air conditioner is determined to be greater than a predetermined high pressure (e.g., 460 psi). High-pressure events may occur due to high ambient temperatures (e.g., greater than 116 degrees Fahrenheit), air conditioner instability, mechanical wear, incorrect charging, etc.

Operation of at least a portion of the air conditioner may be restricted based on a high pressure event (operation 410). For example, operation of compressor(s) and/or fan(s) may be restricted. In some implementations, flow through the expansion device may be restricted (e.g., when the air conditioner is off).

A determination may be made whether a high pressure event has terminated (operation 420). An operation module of the controller may determine whether a high pressure event has terminated. For example, a pressure in at least a portion of the air conditioning system (e.g., condenser and/or proximate a high pressure switch) may be determined and compared to a predetermined high pressure value to determine if the high pressure event is occurring (e.g., determined pressure is greater than or approximately equal to the predetermined high pressure value) and/or has terminated (e.g., determined pressure is less than the predetermined high pressure value).

Operation of the air conditioner may be automatically requested if the high pressure event has terminated (operation 430). For example, a controller (e.g., a module of the controller) may attempt to restart operations after a high pressure event has terminated. In some implementations, the request may be automatically generated based on default set point values and/or set point values from a previous request.

A wait time may be retrieved (operation 440). Since the high pressure event restricted operation of at least a portion of the air conditioner, a wait time may be utilized to stagger initiation of compressors to inhibit a high pressure event (e.g., due to accumulated refrigerant causing a pressure spike at start-up). In some implementations, the wait time may be determined based at least partially on ambient temperatures, previous high pressure event properties (e.g., returning operation after a high pressure event restriction), expansion device properties, and/or other properties of the air conditioner (e.g., relative capacity of components, total capacity, and/or types of components).

Operation of a first compressor may be allowed (operation 450). For example, the controller may transmit a signal such that the first compressor may operate based at least partially on the request for operation. The first compressor may be a single stage compressor and allowed to operate. In some implementations, the first compressor may include more than one stage (e.g., a high stage and at least one lower stage), and the first compressor may be allowed to operate at one of the lower stages.

Operation of a second compressor may be allowed after a period of time equal to the wait time has elapsed (operation 460). For example, the controller may include a counter to monitor time elapsed. After an amount of time has elapsed that is approximately equal to the wait time, the controller may transmit a signal to the second compressor. The second compressor may be allowed to operate based at least partially on the request for operation.

Operation of the air conditioner may be allowed based at least partially on the request for operation (operation 470). For example, operations of the components of the air conditioner may be managed (e.g., by the operation module of the controller) such that the request for operation may be satisfied. When the request for operation is satisfied, operation of at least a portion of the air conditioner may be restricted.

Process 400 may be implemented by various systems, such as system 100. In addition, various operations may be added, deleted, and/or modified. In some implementations, process 400 may be performed in combination with other processes such as process 200 and/or process 300. For example, an ambient temperature may be determined and the wait time may be adjusted based at least partially on the ambient temperatures, if the ambient temperature is greater than a predetermined high ambient temperature. In some implementations, the request for operation may not be automatically generated. A user may request operation of the air conditioner. In some implementations, the controller (e.g., a module of the controller) may adjust the automatic control of the expansion device prior to allowing the first compressor and/or the second compressor to operate. In some implementations, the first compressor may include a multi-stage compressor, which includes a high stage and at least one low stage. Allowing the first compressor to operation may include allowing the compressor to operate at least at one of the low stages and restricting operation of the first compressor at the high stage. In some implementations, the first compressor may be allowed to operate at the high stage initially, during the wait time, and/or after the wait time has elapsed.

In some implementations, a determination may be made whether to allow a wait time. A determination of whether to allow a wait time may be based at least partially on the probability of a high pressure event due to responding to the request. For example, when an air conditioner with two compressors is off, a high probability (e.g., determined probability is greater than a predetermined high probability) of a high pressure event may exist. Thus, when operation of a first set of predetermined portions of the air conditioner (e.g., compressor(s) and/or fan(s)) are restricted, a determination may be made to allow a wait time when initiating operation of the compressors. In some implementations, restriction of some components and/or responding to requests when the air conditioner is on may be associated with a low probability of a high pressure event (e.g., determined probability is less than a predetermined low probability). When operation of the air conditioner was not restricted and/or when operation of a second set of predetermined portions of the air conditioner (e.g., thermostat control panel and/or sensor(s)) were restricted, a determination may be made not to allow a wait time when initiating operation of the compressors. The two or more compressors may then be allowed to initiate operation approximately concurrently.

Although a specific controller has been described in FIG. 1, the controller may be any appropriate computer or other programmable logic device. The controller may include a processor that executes instructions and manipulates data to perform operations of the controller. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include data, such as predetermined property values (e.g., temperatures and/or pressure); predetermined properties of events such as high pressure events and/or other events to facilitate identification of when air conditioner operation should be allowed and/or restricted; wait times, adjustments to wait times, periods of time that operations should run (e.g., maximum operational time); and/or any other data useful to the operation of the air conditioner operations.

In addition, various software may be stored on the memory. For example, instructions (e.g., operating systems and/or other types of software), an operation module, and/or a compressor management module may be stored on the memory. The operation module may include instructions to perform one or more of the operations described in processes 200, 300, and/or 400, such as operating the heat pump during normal operations (e.g., operations in which the system operates based at least partially on user requests for operation). For example, the operation module may receive requests for operation from a user and operate the air conditioner to satisfy the user request. The compressor management module may perform one or of the operations described in the described processes (e.g., processes 200, 300, and/or 400). For example, the compressor management module may receive requests for operation of an air conditioner, automatically request operation of an air conditioner, retrieve wait times, determine wait times, adjust wait times, allow operation of one or more of the compressors, restrict operation of one or more of the compressors, adjust expansion devices (e.g., allow more or less refrigerant to pass through the expansion device and/or adjust automatic control of refrigerant flow provided by an expansion device), determine whether high pressure events have occurred and/or have terminated, determine ambient temperatures, etc.

In some implementations, modules may be combined, such as into a single module or multiple modules. In an implementation, operation modules may include various modules and/or sub-modules.

A communication interface may allow the controller to communicate with components of the air conditioner (e.g., heat pump), other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the air conditioner (e.g., heat pump) stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although FIG. 1 provides one example of controller that may be used with the disclosure, controller can be implemented through computers such as servers, as well as a server pool. For example, controller may include a general-purpose personal computer (PC) a Macintosh, a workstation, a UNIX-based computer, a server computer, or any other suitable device. In some implementations, a controller may include a programmable logic device. For example, the controller may be mounted to a wall of a location in which air conditioning may be provided. According to one implementation, controller may include a web server. Controller may be adapted to execute any operating system including UNIX, Linux, Windows, or any other suitable operating system. Controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although mechanical failure and mechanical failure events have been described as conditions that cause mechanical failure, conditions that precede mechanical failure may also be included, such as excessive wear on parts.

Although users have been described as a human, a user may be a person, a group of people, a person or persons interacting with one or more computers, and/or a computer system.

Various described patents and patent applications have been incorporated by reference. The described patents and patent applications are incorporated by reference to the extent that no conflict exists between the various described systems and/or processes and the described patents and patent applications. Any portion(s) of such described patents and patent applications that are in conflict with the various described systems and/or processes are not incorporated by reference.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a wait time" includes a combination of two or more compressors and reference to "a compressor" includes different types and/or combinations of compressors.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An air conditioner comprising:
a first compressor;
at least one second compressor;
an expansion device;
a memory storing one or more wait times, the one or more wait times based at least partially on a response time of the expansion device; and
a controller adapted to:
receive a request for operation of an air conditioner;
retrieve first and second wait times from the one or more wait times stored in the memory;
restrict operation of the first compressor of the air conditioner for a first period of time approximately equal to the retrieved first wait time;
allow operation of the first compressor of the air conditioner after the first period of time;
restrict operation of the at least one second compressor of the air conditioner for a second period of time approximately equal to the retrieved second wait time; and
allow operation of the at least one second compressor after the second period of time.

2. The air conditioner of claim 1, further comprising a microchannel condenser.

3. The air conditioner of claim 1, further comprising a tandem compressor assembly, wherein the tandem compressor assembly comprises the first compressor and the at least one second compressor.

4. The air conditioner of claim 1, wherein the expansion device comprises a thermal expansion device, and wherein the thermal expansion device comprises:
a bulb, and wherein a temperature of the bulb at least partially controls an amount of refrigerant allowed to pass through the thermal expansion device; and
a heat transfer element; and
wherein the controller is further adapted to:
allow heat transfer between the heat transfer element and the bulb to alter a temperature of the bulb for at least a portion of the retrieved first and second wait times; and
adjust an amount of refrigerant allowed to flow through the thermal expansion device based at least partially on the altered temperature of the bulb.

5. The air conditioner of claim 1, wherein the wait time is based on at least one property of a component of the air conditioner.

6. The air conditioner of claim 1, wherein the first compressor comprises a high stage and at least one low stage, and wherein allowing operation of the first compressor comprises allowing operation of the first compressor at one of the low stages.

7. The air conditioner of claim 1, wherein the controller is further adapted to restrict operation of at least a portion of the air conditioner, and wherein receiving the request for operation comprises receiving the request for operation of the air conditioner when operation of at least the portion of the air conditioner is restricted.

8. A method comprising:

receiving a request for operation of an air conditioner, wherein the air conditioner comprises a plurality of compressors, and wherein operation of at least one of the plurality of the compressors is restricted;

retrieving a first wait time and a second wait time, the first and second wait times based at least partially on a response time of the expansion device;

restricting operation of a first compressor of the plurality of compressors of the air conditioner for a first period of time approximately equal to the retrieved first wait time;

allowing operation of the first compressor of the air conditioner after the first period of time;

restricting operation of a second compressor of the plurality of compressors of the air conditioner for a second period of time approximately equal to the retrieved second wait time;

and allowing operation of the second compressor after the second period of time.

9. The method of claim 8, further comprising determining the wait time based at least partially on at least one of:

a property of the air conditioner, an ambient temperature proximate at least a portion of the air conditioner, or a ratio of a volume of a condenser of the air conditioner to a volume of an evaporator of the air conditioner.

10. The method of claim 8, wherein the first compressor comprises a low stage of operation and at least one higher stage of operation, and wherein allowing operation of the first compressor comprises allowing operation at the low stage, and further comprising:

retrieving the second wait time;

allowing operation of the first compressor at one of the higher stages after a period of time approximately equal to the second wait time.

11. The method of claim 8, wherein the plurality of compressors comprises a tandem compressor assembly, and wherein the tandem compressor assembly comprises the first compressor and the second compressor of the air conditioner.

12. The method of claim 8, wherein the expansion device automatically controls an amount of refrigerant allowed to pass through the expansion device, and further comprising adjusting the automatic control of the expansion device such that the amount of refrigerant allowed to pass during at least a portion of the first and second wait times is greater than the amount of refrigerant allowed to pass during automatic control.

13. The method of claim 8, further comprising:

restricting operation of the at least one of the plurality of compressors based on satisfaction of a previous request for operation of the air conditioner; and wherein receiving the request for operation of the air conditioner comprises receiving the request while the operation of the at least one of the plurality of compressors is restricted based on satisfaction of a previous request.

14. The method of claim 8, wherein operation of the at least one of the plurality of compressors is restricted based on a high pressure event.

15. A method of managing compressor operations comprising:

receiving a request for operation of an air conditioner with a plurality of compressors, wherein operation of at least a portion of the air conditioner is restricted;

determining an ambient temperature proximate the air conditioner;

retrieving a first wait time and a second wait time, the first and second wait times based at least partially on a response time of the expansion device;

adjusting the first and second wait times if the determined ambient temperature is greater than a predetermined high ambient temperature value;

restricting operation of a first compressor of the plurality of compressors of the air conditioner for a first period of time that is approximately equal to the first adjusted wait time if the determined ambient temperature is greater than the predetermined high ambient temperature value or to the first wait time if the determined ambient temperature is less than or equal to the predetermined high ambient temperature value;

allowing operation of the first compressor of the air conditioner;

restricting operation of a second compressor of the plurality of compressors of the air conditioner for a second period of time that is approximately equal to the second adjusted wait time, if the determined ambient temperature is greater than the predetermined high ambient temperature value or to the second wait time if the determined ambient temperature is less than or equal to the predetermined high ambient temperature value; and allowing operation of the second compressor.

16. The method of claim 15, further comprising restricting operation of the second compressor for a period of time that is approximately equal to the retrieved second wait time, if the determined ambient temperature is not greater than the predetermined high ambient temperature value.

17. The method of claim 15, further comprising allowing a heating element to provide heat to a bulb of a thermal expansion device of the air conditioner during the adjusted first and second wait times.

18. The method of claim 15, further comprising:

restricting operation of at least a portion of the air conditioner based on satisfaction of a previous request for operation of the air conditioner; and wherein receiving the request for operation of an air conditioner comprises receiving the request while the operation of at least a portion of the air conditioner is restricted based on satisfaction of a previous request.

19. The method of claim 15, further comprising:

restricting operation of at least a portion of the air conditioner based on a high pressure event;

determining whether the high pressure event has terminated; and automatically requesting operation of the air conditioner when the determination is made that the high pressure event has terminated.

* * * * *